United States Patent [19]

Wissenberg et al.

[11] 4,435,016

[45] Mar. 6, 1984

[54] IN SITU RETORTING WITH FLAME FRONT-STABILIZING LAYER OF LEAN OIL SHALE PARTICLES

[75] Inventors: Herman Wissenberg, Wheatland Township, Willa County, Ill.; Earl D. York; Darrell D. Porter, both of Englewood, Colo.

[73] Assignees: Standard Oil Company (Indiana); Gulf Oil Corp., both of Chicago, Ill.

[21] Appl. No.: 388,610

[22] Filed: Jun. 15, 1982

[51] Int. Cl.[3] ..... E21B 43/247; E21C 41/10

[52] U.S. Cl. ..... 299/2; 166/259

[58] Field of Search ..... 166/259, 260; 299/2, 299/13

[56] References Cited

U.S. PATENT DOCUMENTS

| | | | |
|---|---|---|---|
| 4,007,963 | 2/1977 | Ridley | 299/2 |
| 4,027,917 | 6/1977 | Bartel et al. | 166/259 |
| 4,149,595 | 4/1979 | Cha | 166/259 |
| 4,167,291 | 9/1979 | Ridley | 166/259 X |
| 4,227,574 | 10/1980 | Cha | 166/259 |
| 4,359,246 | 11/1982 | Ricketts | 166/259 X |

*Primary Examiner*—George A. Suchfield

*Attorney, Agent, or Firm*—Thomas W. Tolpin; William T. McClain; William H. Magidson

[57] ABSTRACT

An in situ retort and process are provided for underground retorting of oil shale. The in situ retort is formed with at least one flame front-stabilizing layer of minute lean oil shale particles which serves as a redistribution region or grid. When the flame front is ignited and passed through the retort with a feed gas, the flame front-stabilizing layer will stabilize and enhance horizontal uniformity of the flame front to substantially minimize burning of the product shale oil.

19 Claims, 1 Drawing Figure

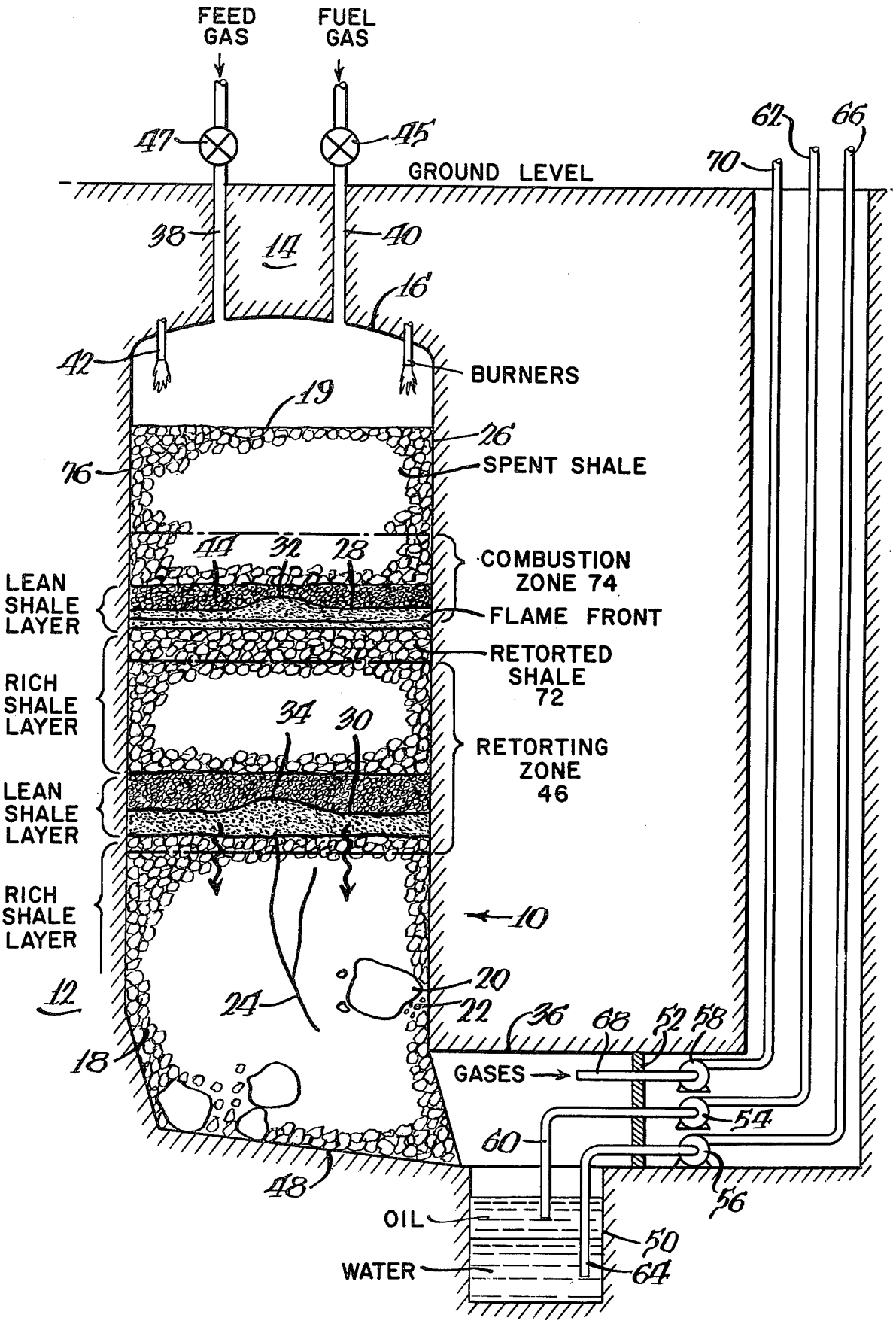
FEED GAS
FUEL GAS
47
45
GROUND LEVEL
62
66
70
38
14
40
16
42
BURNERS
19
26
76
SPENT SHALE
44
32
28
COMBUSTION ZONE 74
LEAN SHALE LAYER
FLAME FRONT
RETORTED SHALE 72
RICH SHALE LAYER
34
30
RETORTING ZONE 46
LEAN SHALE LAYER
RICH SHALE LAYER
10
12
20
24
22
36
68
52
58
18
GASES
54
60
48
56
OIL
50
WATER
64

IN SITU RETORTING WITH FLAME FRONT-STABILIZING LAYER OF LEAN OIL SHALE PARTICLES

BACKGROUND OF THE INVENTION

This invention relates to underground retorting of oil shale.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily useable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil is contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis frcm these vast resources.

Generally, oil shale is a fine-grained sedimentary rock stratified in horizontal layers with a variable richness of kerogen content. Kerogen has limited solubility in ordinary solvents and, therefore, cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts or in underground in situ retorts. In situ retorts require less mining and handling than surface retorts.

In vertical in situ retorts, a flame front moves downward through a rubblized bed containing rich and lean oil shale to liberate shale oil, off gases and condensed water. There are two types of in situ retorts: true in situ retorts and modified in situ retorts. In true in situ retorts, none of the shale is mined, holes are drilled into the formation and the oil shale is explosively rubblized, if necessary, and then retorted. In modified in situ retorts, some of the oil shale is removed by mining to create a cavity which provides extra space for explosively rubblized oil shale. The oil shale which has been removed is conveyed to the surface and retorted above ground.

While efforts are made to explosively rubblize the oil shale into uniform pieces, in reality the rubblized mass of oil shale contains numerous different sized fragments of oil shale which create vertical, horizontal and irregular channels extending sporadically throughout the bed and along the wall of the retort. As a result, during retorting, hot gases often flow down these channels and bypass large portions of the bed, leaving significant portions of the rubblized shale unretorted.

Different sized oil shale fragments, channeling and irregular packing, and imperfect distribution of oil shale fragments cause other deleterious effects including tilted (nonhorizontal) and irregular flame fronts in close proximity to the retorting zone and fingering, that is, flame front projections which extend downward into the raw oil shale and advance far ahead of other portions of the flame front. Irregular flame fronts and fingering can cause coking, burning, and thermal cracking of the liberated shale oil. Irregular, tilted flame fronts can lead to flame front breakthrough and incomplete retorting. In the case of severe channeling, horizontal pathways may permit oxygen to flow underneath the raw unretorted shale. If this happens, shale oil flowing downward in that zone may burn. It has been estimated that losses from burning in in situ retorting can be as high as 40% of the product shale oil.

Typifying the many methods of in situ retorting are those found in U.S. Pat. Nos. 1,913,395; 1,191,636; 2,418,051; 3,001,776; 3,586,377; 3,434,757; 3,661,423; 3,951,456; 3,980,339; 4,007,963; 4,017,119; 4,126,180; 4,133,380; 4,149,752; 4,194,788 and 4,243,100. These prior art processes have met with varying degrees of success.

It is, therefore, desirable to provide an improved in situ oil shale retort and process which overcomes most, if not all, of the above problems.

SUMMARY OF THE INVENTION

An improved in situ oil shale retort and process are provided which enhance flame front uniformity and increase product yield and quality.

In accordance with the invention, a novel retort is formed with at least one flame front-stabilizing layer of lean oil shale particles. Desirably, the flame front-stabilizing layer extends across the retort and has an average particle size substantially smaller than the rest of the oil shale particles in the retort. In the preferred mode, the lean oil shale particles in the flame front-stabilizing layer have an average particle size from 0.01 inch to 0.1 inch.

The flame front-stabilizing layer can be formed explosively or mechanically. In explosively forming the flame front-stabilizing layer, part or all of one or more layers of lean shale are blasted into small particles with specially set charges. Preferably, the charges are detonated during explosive rubblization of the underground oil shale formation. In mechanically forming the flame front-stabilizing layer, lean oil shale is crushed and screened above ground and then poured into blast holes or other openings for conveyance to the retort to form the stabilizing layer on top of the rich oil shale. This step can be repeated between blasts, if desired, to cover additional layers of rich oil shale, especially if the formation is being sequentially rubblized in an upward direction.

After the retort has been formed, a flame front is ignited across the retort and is driven through the rubblized mass, including the flame front-stabilizing layer, by an oxygen-containing gas to liberate an effluent product stream of shale oil and light hydrocarbon gases from the raw oil shale. The stabilizing layer of substantially smaller particles increases the pressure drop across the layer. When the part of the flame front which is progressing at a more rapid rate experiences the higher pressure drop, it slows down and forces more air into the slower moving portions of the flame front, causing the flame front to even out. Each flame front-stabilizing layer serves as a redistribution region or grid-like baffle which creates a pressure drop in the retort to generally stabilize and enhance uniformity of the flame front and substantially minimize flame front breakthrough and fingering in order to prevent incomplete retorting and burning of the effluent product stream of shale oil and light hydrocarbon gases.

Vertical, irregular shaped and preferably generally upright modified in situ retorts can be formed and retorted in the above manner.

As used throughout this application, the terms "retorted oil shale" and "retorted shale" refer to oil shale which has been retorted to liberate hydrocarbons leaving an inorganic material containing carbon residue.

The terms "spent oil shale" and "spent shale" as used herein mean retorted shale from which most of the residual carbon has been removed by combustion.

A more detailed explanation of the invention is provided in the following description and appended claims taken in conjunction with the accompanying drawing.

BRIEF DESCRIPTION OF THE DRAWING

The FIGURE is a schematic cross-sectional view of a modified in situ retort for carrying out a process in accordance with principles of the present invention.

DETAILED DESCRIPTION OF THE PREFERRED EMBODIMENT

Referring now to the drawing, an underground modified in situ, oil shale retort 10 located in a subterranean formation 12 of oil shale is covered with an overburden 14. Retort 10 is elongated, upright and generally box-shaped with a flat or dome-shaped roof or top 16. Retort 10 is filled with an irregularly packed, fluid-permeable, rubblized mass or bed 18 of oil shale. The top 19 of the bed is spaced below the roof. Irregular, horizontal, and vertical channels 24 extend throughout the bed and along the walls 26 of the retort.

The bed 18 contains alternate different sized (depth) layers of rich and lean oil shale particles of varying degrees of richness and leanness. Lean oil shale has a smaller average particle size and is more brittle and fragile than rich oil shale. In the preferred embodiment, the average shale particle size in the bed, outside the flame front-stabilizing layers 28 and 30, is 1 to 3 inches. The rich oil shale layers can contain boulders 20 of 10 inches or more. The lean oil shale layers and portions surrounding the boulders as well as other regions can contain some fines 22.

Lean oil shale yields an average of 7.7 to 16.6 gallons of shale oil per ton of oil shale. Rich oil shale yields an average of 15.0 to 32.4 gallons or more of shale oil per ton of oil shale. Some of the very rich sections of oil shale in Colorado yield as much as 65 to 85 gallons of shale oil per ton of shale. While the yield averages of lean and rich oil shale discussed above appear to overlap, they are relative terms for any given retort. Generally the lower ends or higher ends of the ranges are used, but not both, for a given retort.

Flame front-stabilizing layers 28 and 30 of lean oil shale particles extend entirely, horizontally across one or more layers of rich or lean oil shale. The lean oil shale particles in the flame front-stabilizing layers have a much smaller average particle size than the other rich and lean oil shale particles in the bed. In the preferred embodiment, the lean oil shale particles in the flame front-stabilizing layers have an average particle size from 0.01 inch to 0.1 inch for most effective flame front stabilization.

The flame front-stabilizing layers 28 and 30 extend horizontally across the retort and provide redistribution regions or zones which serve as grid-like baffles to create pressure drops in the retort. In the illustrative embodiment, the flame front-stabilizing layers lie on top of the rich oil shale layers and are at the bottom of the lean oil shale layers. Explosively formed layers 28 and 30 tend to be humped so as to each have an upwardly extending parabolic portion or arched profile 32 and 34 along the vertical center line of the retort. In retorts of large cross-section, the degree of humping can be reduced, if desired, by varying the blasting pattern.

The rubblized mass is formed by first mining an access tunnel or drift 36 extending horizontally into the bottom of the retort and removing from 2% to 40% and preferably from 15% to 25% by volume of the oil shale from a central region of the retort to form a cavity or void space. The removed oil shale, which typically includes both rich and lean oil shale particles, is conveyed to the surface and retorted in an aboveground retort. The mass of oil shale surrounding the cavity is then fragmented and expanded by detonation of explosives to form the rubblized mass.

In the preferred method of explosively forming the retort, the mass of oil shale is explosively fragmented and rubblized progressively upwardly in sections from the bottom portion of the retort. The explosives are lowered into the desired sections through a series or pattern of blast holes 38 and 40 and the sections are intermittently and sequentially exploded. The flame front-stabilizing layers can be explosively formed simultaneously with the surrounding oil shale in the retort by using more powerful explosives or charges at the bottom of the lean layers.

Alternately, lean oil shale which has been removed from the retort and brought to the surface, can be crushed and screened above ground to the desired particle size and fed into the retort to cover the rich layers through blast holes 38 and 40 between explosions. Preferably, the flame front-stabilizing layers have a depth of at least two feet so that the piles of crushed lean oil shale particles will spread out in a generally uniform manner across the retort. When mechanically produced, crushed and screened lean oil shale particles are used, the stabilizing layer can be formed with minimal humping as described above or can have humps at different locations, such as at walls, corners, etc., if desired, by varying the locations of the blast holes into which the lean oil shale particles are poured. After the crushed lean particles are fed into the retort, the next upward section of raw oil shale is explosively fragmented, and the step is repeated as desired. Subsequent explosive rubblization enhances the distribution and uniformity of the flame front-stabilizing layers.

After the oil shale has been explosively rubblized and the flame front-stabilizing layers formed, one or more feed gas lines and fuel lines can be inserted into the blast holes 38 and 40, and downhole burners 42 can be installed. Lines 38 and 40 and burners 42 extend vertically from above ground through the roof 16 of the retort. The bottom of the burners can be located in the empty space between the top 19 of the bed and the roof.

In order to commence retorting of the rubblized oil shale, a liquid or gaseous fuel, preferably a fuel gas, such as recycle off gases or natural gas, is fed into the retort through fuel line 40 and an oxygen-containing, flame front-supporting, feed gas, such as air, is fed into the retort through feed gas line 38. Burners 42 are then ignited to establish a flame front 44 horizontally across the bed 18. If economically feasible or otherwise desirable, the rubblized mass of oil shale can be preheated to a temperature slightly below its retorting temperature, desirably with inert preheating gas, such as steam, nitrogen or retort off gases, before introduction of the oxygen-containing feed gas and ignition of the flame front.

After ignition, fuel gas valve 45 is closed to shut off inflow of fuel gas. Once the flame front is established, residual carbon contained in the oil shale usually provides an adequate source of fuel to maintain the flame front in the rich shale as long as the oxygen-containing feed gas is supplied to the flame front. The lean shale may have to be supplemented such as with fuel gas or some of the residual shale oil in the retorting zone.

The feed gas sustains and drives the flame front 44 downwardly through the bed 18. The feed gas can be air, or air enriched with oxygen, or air diluted with steam or recycle retort off gases, as long as the feed gas has at least 5% and preferably from 10% to 30% and most preferably a maximum of 20% by volume oxygen. The oxygen content of the feed gas can be varied throughout the process.

Flame front 44 emits combustion off gases and generates heat which moves downwardly ahead of flame front 44 and heats the raw, unretorted oil shale in retorting zone 46 to a retorting temperature from 900° F. to 1,200° F. to retort and pyrolyze the oil shale in retorting zone 46. During retorting, hydrocarbons are liberated from the raw oil shale as a gas, vapor, mist or liquid droplets and most likely a mixture thereof. The liberated hydrocarbons include light gases and normally liquid shale oil which flow downward, condense and liquify upon the cooler, unretorted raw shale below the retorting zone.

Off gases emitted during retorting include various amounts of hydrogen, carbon monoxide, carbon dioxide, ammonia, hydrogen sulfide, carbonyl sulfide, oxides of sulfur, nitrogen, water vapors, and low molecular weight hydrocarbons. The composition of the off gas is dependent on the composition of the feed gas.

The effluent product stream of liquid oil, condensed water and off gases, flows downward to the sloped bottom of the retort and then into a collection basin and separator 50, also referred to as a "sump" in the bottom of access tunnel 36. Concrete wall 52 prevents leakage of off gas into the mine. The liquid shale oil, water and gases are separated in collection basin 50 by gravity and pumped to the surface by pumps 54 and 56 and blower 58, respectively, through inlet and return lines 60, 62, 64, 66, 68 and 70, respectively.

Raw off gases can be recycled as part of the fuel gas or feed gas, either directly or after light gases and oil vapors contained therein have been stripped away in a quench tower or stripping vessel.

During the retorting process, retorting zone 46 moves downward leaving a layer or band 72 of retorted shale with residual carbon. Retorted shale layer 72 above retorting zone 46 defines a retorted zone which is located between retorting zone 46 and the flame front 44 of combustion zone 74. Residual carbon in the retorted shale is combusted in combustion zone 74 leaving spent, combusted shale in a spent zone 76.

As the flame front 44 passes downwardly through the rubblized mass of oil shale, it has a tendency to become irregular, tilted and nonuniform and form fingers or projections of high temperature which extend significantly ahead of other portions of the flame front. The flame front-stabilizing layers 28 and 30 of lean oil shale provide redistribution regions which generally stabilize and enhance uniformity of the flame front, and minimize flame front fingering and breakthrough, as the flame front moves through each flame front-stabilizing layer.

Among the many advantages of the above process and retort are:

1. Improved product yield and recovery.
2. Uniformity of flame front.
3. More complete retorting.
4. Less loss of product oil.
5. Prevention of gas explosions.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for retorting oil shale, comprising the steps of:

forming an underground retort of oil shale having at least one flame front-stabilizing layer of lean oil shale particles; and moving a flame front substantially through said retort to liberate shale oil from said oil shale, including passing said flame front through said flame front-stabilizing layer to generally stabilize and enhance uniformity of said flame front and substantially minimize burning of said shale oil.

2. A process in accordance with claim 1 wherein said flame front-stabilizing layer is explosively formed.

3. A process in accordance with claim 1 wherein said layer is derived from lean oil shale particles that have been crushed and screened above ground and fed into said underground retort.

4. A process in accordance with claim 3 wherein said crushed and screened oil shale is fed into said retort through blast holes.

5. A process in accordance with claim 1 wherein said retort is generally upright.

6. A process in accordance with claim 1 wherein said retort is a modified in situ retort.

7. A process in accordance with claim 1 wherein said retort has an irregular shape.

8. A process for retorting oil shale, comprising the steps of:

forming a generally vertical, modified in situ, underground retort in a subterranean formation of oil shale containing alternate layers of rich oil shale and lean oil shale by removing a portion of said oil shale from said subterranean formation to define a cavity, explosively fragmenting said oil shale generally surrounding said cavity to rubblize said layers, and forming at least one flame front-stabilizing zone of lean oil shale particles extending generally across said retort having an average particle size substantially smaller than the rest of said oil shale in said rubblized layers;

igniting a flame front generally across the top rubblized layer of said retort;

supporting said flame front with an oxygen-containing gas; and driving said flame front generally downwardly through said layers of oil shale in said retort with said oxygen-containing gas to liberate an effluent product stream of shale oil and light hydrocarbon gases from said oil shale, including passing said flame front generally downwardly through said flame front-stabilizing zone to generally stabilize and enhance horizontal uniformity of said flame front and substantially minimize flame front breakthrough, fingering and burning of said effluent product stream.

9. A process in accordance with claim 8 wherein said lean oil shale particles in said flame front-stabilizing zone have an average particle size ranging from 0.01 inch to 0.1 inch.

10. A process in accordance with claim 9 wherein:

said lean oil shale yields an average of 7.7 to 16.6 gallons of shale oil per ton of oil shale;

said rich oil shale yields an average of 15.0 to 32.4 gallons of shale oil per ton of oil shale;

from 2% to 40% by volume of said oil shale is removed from said subterranean formation; and said explosive fragmentation occurs progressively upwardly in sections through said retort.

11. A process in accordance with claim 10 wherein from 2% to 40% by volume of said oil shale is removed from said subterranean formation, and said flame front-stabilizing zone defines a grid.

12. A process in accordance with claim 10 wherein said flame front-stabilizing zone is explosively formed in one of said lean layers simultaneously with said explosive fragmentation.

13. A process in accordance with claim 12 wherein said flame front-stabilizing zone is a bed at the bottom of one of said lean layers with an upwardly extending arched profile.

14. A process in accordance with claim 10 wherein:

a portion of said removed oil shale is lean oil shale;

said removed lean shale is crushed to said average particle size above ground;

said explosive fragmentation occurs intermittently; and said crushed lean shale is fed through blast holes into said retort between explosions to substantially cover some of said fragmented shale.

15. A process in accordance with claim 14 wherein said crushed lean shale is deposited upon at least one of said layers of rich shale.

16. A process in accordance with claim 8 wherein said flame front-stabilizing zone defines a baffle creating a pressure drop in said retort.

17. A process in accordance with claim 8 wherein said layers have different depths and said flame front-stabilizing zone provides a redistribution region.

18. An underground retort, comprising:

an overburden defining a roof;

an elongated generally upright rubblized mass of oil shale particles in a subterranean formation spaced below said roof, said rubblized mass including alternate layers of rich oil shale particles and lean oil shale particles;

a flame front-stabilizing region of lean oil shale particles ranging in size from 0.01 inch to 0.1 inch extending generally across one of said layers;

burner means extending downwardly through said roof for igniting a flame front; and feed gas means for feeding an oxygen-containing gas into said flame front.

19. An underground retort in accordance with claim 18 wherein said flame front-stabilizing region has an upwardly extending parabolic portion.

* * * * *